United States Patent [19]

Oglesbee

[11] 3,951,259

[45] Apr. 20, 1976

[54] PACKAGE FOR TUMBLERS AND THE LIKE

[75] Inventor: Richard K. Oglesbee, Lancaster, Ohio

[73] Assignee: Anchor Hocking Corporation, Lancaster, Ohio

[22] Filed: Mar. 12, 1975

[21] Appl. No.: 557,637

[52] U.S. Cl. ..... 206/164; 206/203; 206/427; 220/23.83

[51] Int. Cl.[2] ..... B65D 85/30; B65D 85/62; B65D 75/00

[58] Field of Search ..... 206/203, 164, 163, 162, 206/139, 145, 427; 220/23.4, 23.83

[56] References Cited

UNITED STATES PATENTS

| | | | |
|---|---|---|---|
| 2,431,713 | 12/1947 | Stigler | 206/163 |
| 2,499,126 | 2/1950 | Bassichis | 206/164 |
| 3,003,805 | 10/1961 | Glazer | 206/162 |
| 3,261,498 | 7/1966 | Erickson | 206/164 |
| 3,693,830 | 9/1972 | Oglesbee | 206/162 |

*Primary Examiner*—William T. Dixson, Jr.
*Attorney, Agent, or Firm*—Holland, Armstrong, Wilkie & Previto

[57] ABSTRACT

A package is described for storing, shipping, displaying, and serving articles such as glass or plastic tumblers. The package is formed of molded plastic sections including a base, a top, and a handle. The preferred base is adapted to receive the bottoms of pairs of tumblers in cups positioned on opposite sides of a central panel so that the package will accommodate a number of pairs of articles in the assembled base and a snap-on top. A handle is slidably mounted in the top for movement between a recessed position and a raised package carrying position.

5 Claims, 6 Drawing Figures

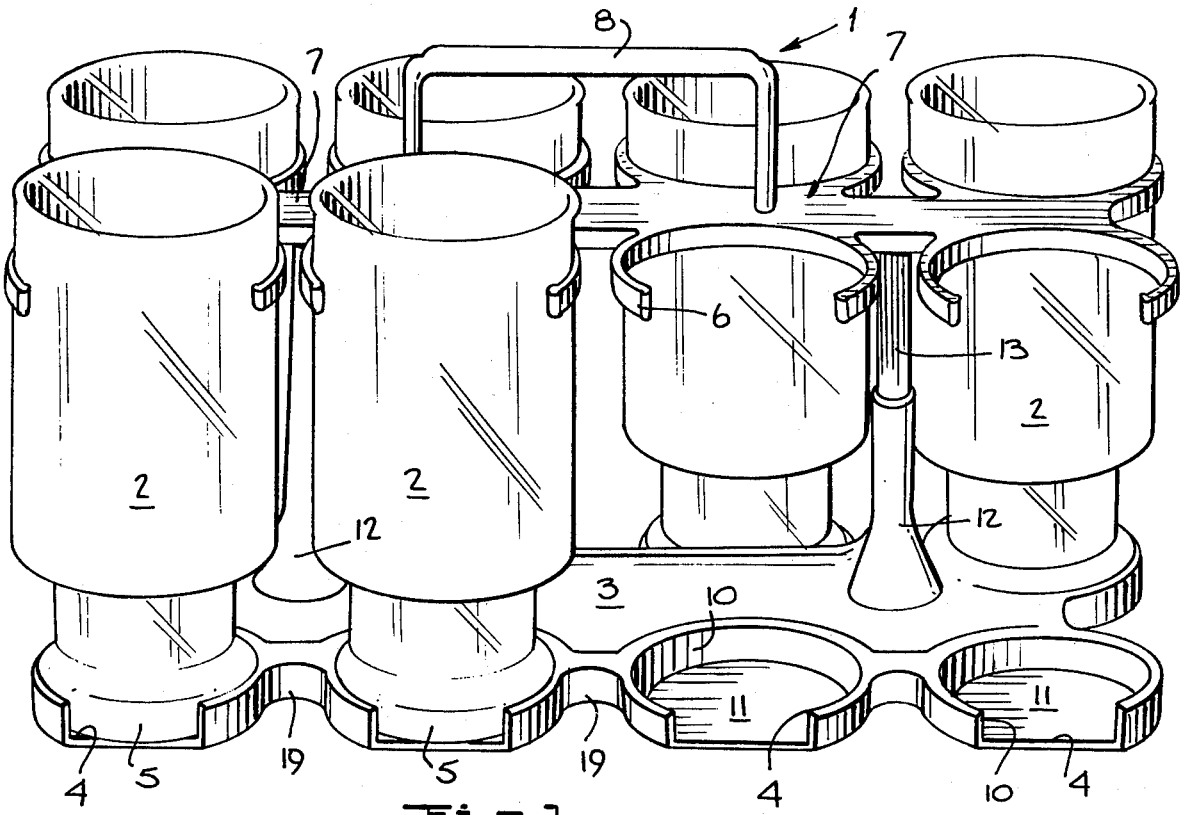
Fig. 1.
Fig. 5.
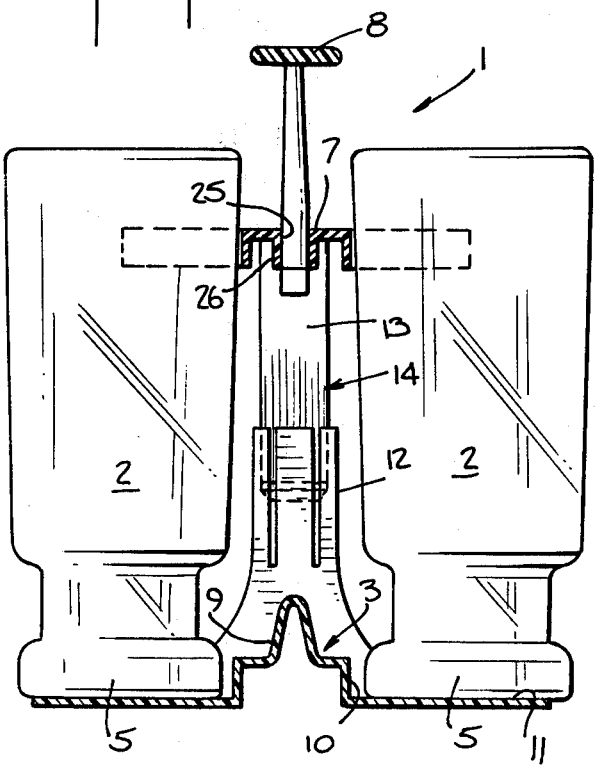
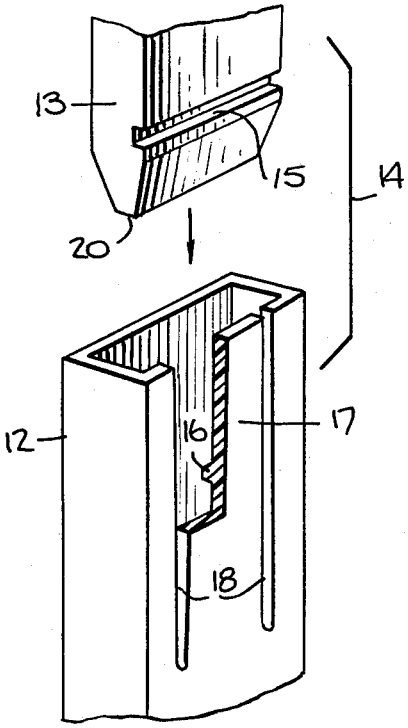
Fig. 6.

PACKAGE FOR TUMBLERS AND THE LIKE

BACKGROUND OF THE INVENTION

The present invention relates to an improved plastic package for tumblers or similar articles which is adapted for multiple use as a shipping or storage package, a display package, and finally as a serving tray. A relatively simple and attractive package formed of molded plastic sections is provided for this purpose including a base and a cover portion and a recessible handle.

Modern merchandizing methods for articles sold in retail outlets and particularly for articles such as glass or plastic tumblers require inexpensive and practical packages which serve one or more functions. Such packages minimize distribution costs by providing means for packaging and displaying and for subsequently serving the articles. The package of the present invention is a shaped plastic package particularly suitable for these purposes and which is produced in an attractive form at relatively low cost. In particular, this improved package provides a package more readily suited for the several functions and which is at the same time relatively inexpensive and easy to produce for handling varying numbers of pairs of articles.

A preferred embodiment of the package includes a molded plastic base including a plurality of spaced article receiving cups preferably arranged in opposed pairs together with a pair of spaced pedestals for receiving depending arms on the cooperating package top. The package top has article engaging clips or grips corresponding in number to the cups on the package base and also mounts a recessible package handle.

The package is an improvement, particularly for handling six or more articles, of the packages shown in my U.S. Pat. Nos. 3,693,830 of Sept. 26, 1972 and 3,760,974 of Sept. 25, 1973, and the Raymond C. Frey U.S. patent application filed Aug. 15, 1973, all entitled Package for Tumblers and the Like.

Accordingly, an object of the present invention is to provide an improved package for articles such as tumblers and the like.

Another object of the invention is to provide an improved molded plastic package for supporting a plurality of tumblers and the like.

Another object of the invention is to provide a strong and lightweight combined shipping and display package for glass or plastic articles, such as tumblers.

Another object of the invention is to provide an improved and inexpensive package adaptable for use as a tumbler serving tray.

Another object of the invention is to provide an improved plastic package for tumblers and the like adaptable for use for differing numbers of pairs of tumblers or similar articles.

Another object of the invention is to provide an improved waterproof, moisture resistant, and inexpensive package for glass or plastic tumblers or similar articles.

Other and further objects of the invention will be obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a perspective view of a preferred embodiment of the package of the invention.

FIG. 5 is a vertical sectional view of the package taken along line 5—5 on FIG. 3; and FIG. 6 is an enlarged fragmentary perspective view illustrating a preferred coupling means for the package base and top sections.

DESCRIPTION OF THE PREFERRED EMBODIMENT

Figure 2:
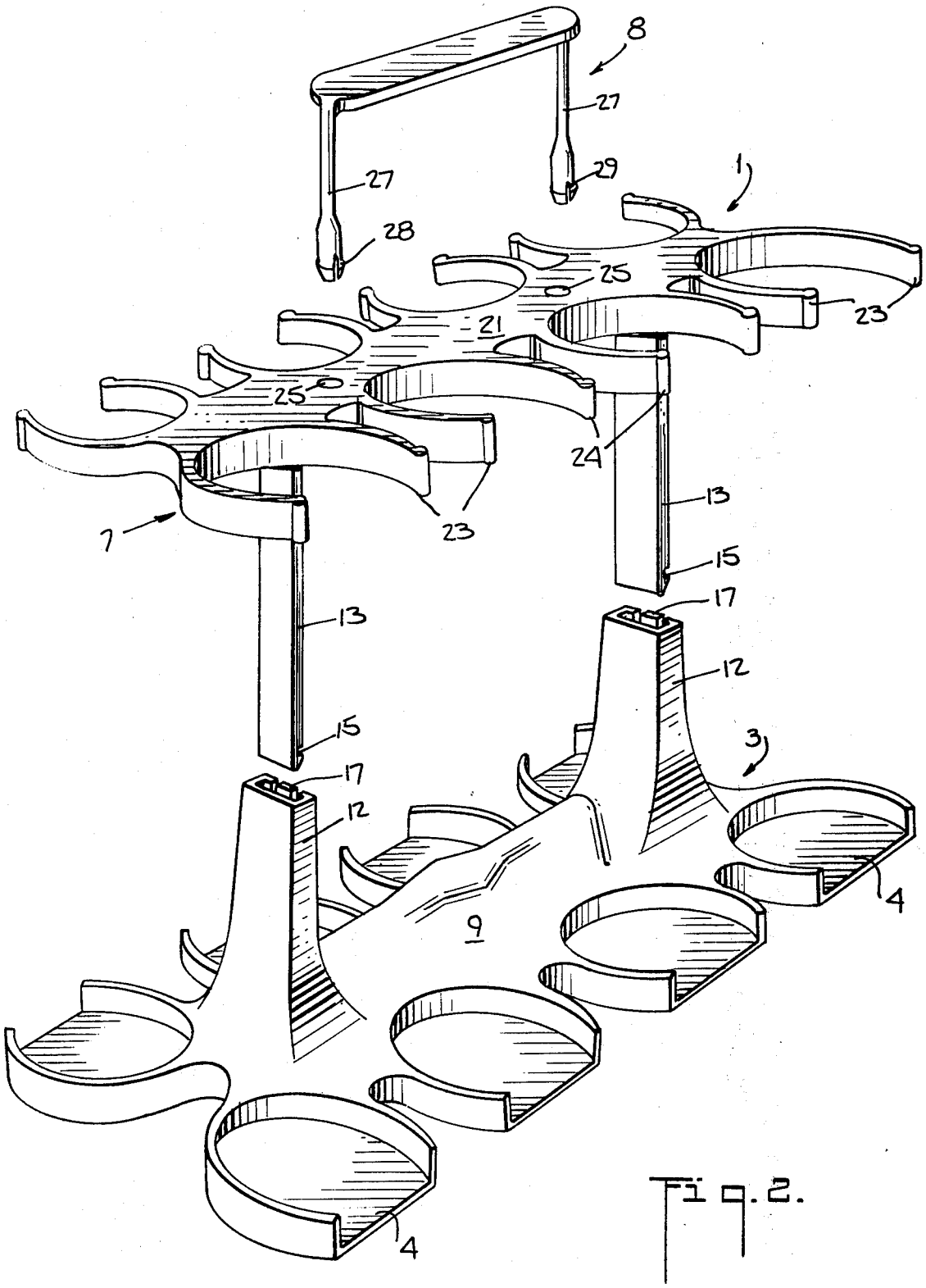
FIG. 2 is an exploded perspective view of the package of the present invention.
Figure 4:
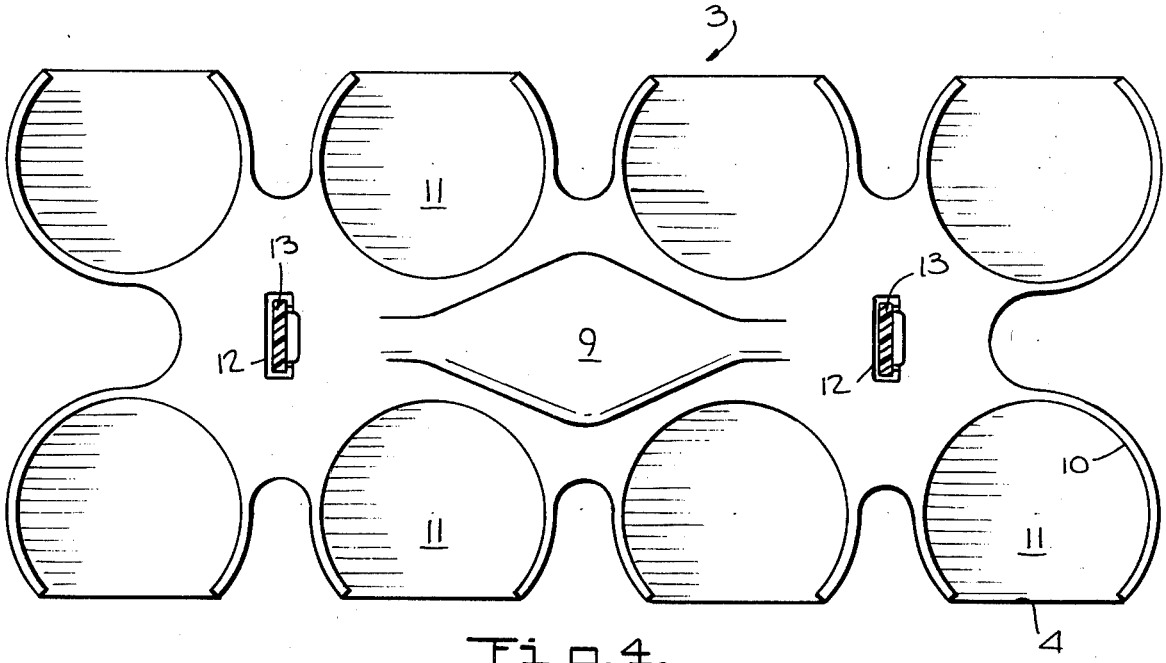
FIG. 4 is a horizontal sectional view of the package taken along line 4—4 on FIG. 3.

FIG. 1 illustrates a preferred embodiment of the package 1 of the invention as used with eight glass or plastic tumblers 2. FIG. 1 illustrates the package 1 supporting the tumblers 2 in a manner for facilitating the shipment of the tumblers within an outer container or the use of the package 1 alone for displaying the tumblers at a retail outlet. The tumblers 2 having circular bottoms 5 engaging cups 4 in the package bottom 3 and their upper portions are engaged by flexible clips 6 on the package top 7.

In FIG. 1, a package handle 8 is shown in its raised position for handling of the package 1.

The details of the preferred embodiments of the package bottom 3, the top 7, and the handle 8 are illustrated in FIGS. 2 through 6.

The package bottom 3 as well as the other sections of the package 1 are preferably and conveniently formed by known molding operations using a resin such as one of the well known high impact resistant polystyrenes. The molded base, for example, includes a central panel 9 supporting a plurality of opposed pairs of the article receiving cups 4. The cups 4 have generally vertical side walls 10 partially surrounding a cup bottom 11. In the case of generally cylindrical tumblers, the side walls 10 describe a portion of a circle so that they engage and retain the circular bottoms of the packaged tumblers 2.

Figure 3:
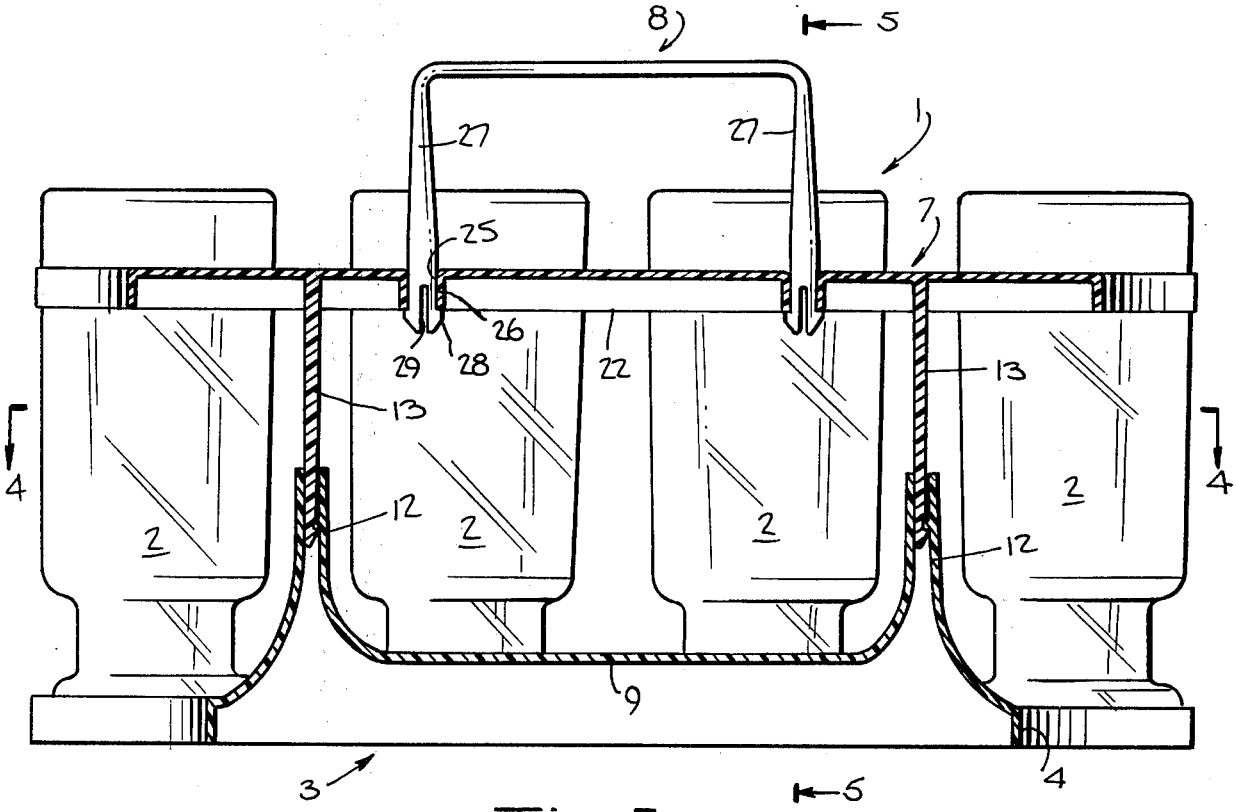
FIG. 3 is a vertical sectional view of the package of FIGS. 1 and 2 showing the handle in its raised package carrying position.

In order to provide an attractive and sanitary package, the bottom 3 of the package 1 is formed, as illustrated in FIG. 3, with its exposed upper panel 9 forming a principal structural section of the bottom 3. The panel 9 mounts two top arm receiving pedestals 12 molded as an integral portion of the bottom 3. The top 7 includes two spaced arms 13 which are received in locking engagement with the pedestals to form posts 14. The preferred lock comprises slots 15 in the arms 13 above tapered arm ends 20 which engage cooperating detents 16 flexibly mounted on tangs 17 on pedestals 12. The preferred flexible mounting for the tangs 17 is provided by vertical slots 18 provided on opposite sides of the tangs 17. Stiffening flanges 19 are provided on the package bottom 3.

It is clear that the positions of the detents 16 and slots 15 may be reversed by providing detents on the top arms 13 and slots in the tangs 17 on the pedestals 12.

A preferred embodiment of the top 7 is conveniently molded in one piece from high impact resistant polystyrene or a similar resin. The top 7 has a supporting panel 21 with depending flange portions 22 and rounded article engaging clips 23. The two bottom engaging arms 13 depend downwardly from the panel 21 and, as already indicated, may conveniently be formed as unitary portions of the top 7 during its shaping or molding.

To facilitate the placement of the articles in the clips 23 and to provide smooth ends for the clips 23, rounded ends 24 are preferably formed on the ends of the clips 23. The package 1 is assembled before or during the article loading operation when the arms 13 are moved downwardly into spaced pedestals 12 on the bottom 3 until the slots in the post engage flexibly mounted detents on the base in the manner illustrated in FIGS. 3 and 5.

A pair of apertures 25 are provided in the top 7 with downwardly depending flanges 26. The apertures 25 receive the spaced vertical portions 27 of the handle 8. The vertical portions 27 are slidably mounted in the apertures 25 permitting the handle 8 to be moved from a raised gripping position to a lowered shipping position. The preferred embodiment of the handle 8 includes locking tabs 28 provided on opposite sides of a central slot 29. This facilitates the initial assembly of the package 1 by permitting the handle 8 to be snapped into place in the apertures 25 and also acts to set the raised position of the handle 8 and to releasably hold it in its raised position.

It will be seen that an improved lightweight, rugged, and attractive plastic package has been provided for glass or plastic tumblers or similar articles. The package is inexpensive to manufacture and is water and moisture proof so that it protects the packaged articles for indefinite periods including storage periods in damp locations. The multiple-use feature of the package additionally make it particularly attractive for use with plastic or glass tumblers where it serves not only for shipment and display but also for continuing use as a serving tray or caddy.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. A molded plastic package for containing rows of tumblers comprising the combination of:

an elongated molded plastic base having an elongated panel which is channel-shaped in cross-section and which has rows of cup-like means for engaging bottoms of the packaged tumblers positioned on opposite sides of the panel;

a pair of hollow spaced pedestals on said base including apertures at their tops for receiving package top mounting arms;

flexible top members on the pedestals for releasably engaging package top mounting arm members;

a molded plastic top having an elongated panel and having a plurality of arcuate tumbler gripping clips arranged in rows on opposite sides of the panel;

a pair of package top mounting arm members depending from said elongated top panel with each one positioned for entering one of said pedestals;

a slot and detent lock with the slot being positioned on one of said members and the detent being positioned on the other of said members for releasably locking said arms and pedestals;

a recessible handle movably mounted on said top intermediate to said arm members; and said handle being slidably mounted on said top for movement between a raised carrying position and a recessed position.

2. The plastic package as claimed in claim 1 for use in packaging generally cylindrical tumblers in which said cup-like means comprise arcuate side walls for partially surrounding the tumbler bottoms, and said clips comprise arcuate members for partially surrounding upper portions of said tumblers.

3. The plastic package as claimed in claim 1 in which a pair of spaced apertures are provided in said top for mounting said handle, and said handle having a pair of generally vertical portions slidably engaged in said apertures and terminating in flexible locking tabs.

4. The plastic package as claimed in claim 1 in which said flexible top members on said pedestals comprise flexible tangs including means thereon for engaging the locking means on said arms.

5. The plastic package as claimed in claim 4 in which the means on said tangs comprise detents, and the locking means on said arms comprise slots.

* * * * *